US007079105B2

(12) United States Patent
Katagawa

(10) Patent No.: US 7,079,105 B2
(45) Date of Patent: Jul. 18, 2006

(54) LIQUID CRYSTAL DISPLAY WITH PRE-WRITING AND METHOD FOR DRIVING THE SAME

(75) Inventor: Koichi Katagawa, Kawasaki (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 10/430,834

(22) Filed: May 6, 2003

(65) Prior Publication Data

US 2003/0193461 A1 Oct. 16, 2003

Related U.S. Application Data

(62) Division of application No. 09/706,994, filed on Nov. 6, 2000, now Pat. No. 6,600,469.

(30) Foreign Application Priority Data

Jan. 7, 2000 (JP) ..... 2000-001490

(51) Int. Cl.
*G09G 3/36* (2006.01)

(52) U.S. Cl. ..... 345/99; 345/98

(58) Field of Classification Search ..... 345/87, 345/92, 94, 98–101, 204, 690
See application file for complete search history.

(56) References Cited

U.S. PATENT DOCUMENTS

| | | | | |
|---|---|---|---|---|
| 4,750,813 | A * | 6/1988 | Ohwada et al. | 345/87 |
| 5,742,269 | A | 4/1998 | Hayashiguchi et al. | 345/87 |
| 5,959,600 | A | 9/1999 | Uchino et al. | 345/94 |
| 6,018,331 | A | 1/2000 | Ogawa | 345/99 |
| 6,020,214 | A * | 2/2000 | Watanabe et al. | 438/30 |
| 6,052,103 | A | 4/2000 | Fujiwara et al. | 345/89 |
| 6,191,779 | B1 | 2/2001 | Taguchi | 345/204 |
| 6,320,575 | B1 | 11/2001 | Terashima et al. | 345/213 |
| 6,407,729 | B1 * | 6/2002 | Moon | 345/99 |
| 6,417,847 | B1 | 7/2002 | Mametsuka | 345/213 |
| 6,587,089 | B1 * | 7/2003 | Nakajima | 345/99 |
| 6,600,469 | B1 * | 7/2003 | Nukiyama et al. | 345/87 |
| 6,670,935 | B1 * | 12/2003 | Yeon et al. | 345/89 |
| 6,717,563 | B1 * | 4/2004 | Kim | 345/96 |
| 2001/0022570 | A1 * | 9/2001 | Chang et al. | 345/98 |
| 2002/0075212 | A1 | 6/2002 | Song | 345/87 |
| 2002/0084960 | A1 | 7/2002 | Song et al. | 345/87 |

FOREIGN PATENT DOCUMENTS

| | | |
|---|---|---|
| JP | 02168229 | 6/1990 |
| JP | 05035215 | 2/1993 |
| JP | 05265411 | 10/1993 |
| JP | 11003070 | 1/1999 |
| JP | 11142807 | 5/1999 |
| JP | 2001092422 A * | 4/2001 |

* cited by examiner

*Primary Examiner*—Amr A. Awad
*Assistant Examiner*—Tom Sheng
(74) *Attorney, Agent, or Firm*—Greer, Burns & Crain, Ltd.

(57) ABSTRACT

A liquid crystal display including a gate driver for outputting a gate signal to gate bus lines connected to gate electrodes of a plurality of thin film transistors; a plurality of data drivers for outputting data to a plurality of data bus lines respectively connected to drain electrodes of the plurality of thin film transistors; and a timing controller having at least one latch pulse supply line which is extracted from the gate driver and is provided substantially in parallel with the gate bus lines for supplying a latch pulse for outputting data to the plurality of data drivers at output timing which is varied depending on the distance from the gate driver.

1 Claim, 14 Drawing Sheets

PRIOR ART

LIQUID CRYSTAL DISPLAY WITH PRE-WRITING AND METHOD FOR DRIVING THE SAME

BACKGROUND OF THE INVENTION

This is a divisional of application Ser. No. 09/706,994, filed Nov. 6, 2000, now U.S. Pat. No. 6,600,469.

FIELD OF THE INVENTION

The present invention relates to a liquid crystal display and a method of driving the same and, more particularly, to an active matrix liquid crystal display utilizing thin film transistors (TFTs) as switching elements (hereinafter referred to as "TFT-LCD") and a method of driving the same.

DESCRIPTION OF THE RELATED ART

The recent trend toward TFT-LCDs with higher definition has resulted in an increase in a driving frequency of a gate pulse applied to a gate of each TFT. Further, the trend toward TFT-LCDs with greater screen sizes has resulted in a tendency toward greater wiring lengths and higher wiring resistances of gate bus lines for supplying a gate pulse and data bus lines for outputting grayscale data to a plurality of pixels arranged in the form of a matrix. This results in a problem in that the wiring resistance of a gate bus line can round the gate waveform to cause delays in the timing at which gates are turned off in regions apart from the gate driver. A driving method as shown in FIG. 20 has been adopted in order to avoid this. According to this conventional driving method, the data switching timing of a data voltage Vd output from a data driver to a data bus line is shifted behind the gate-off timing of a gate pulse Vd output from a gate driver to a gate bus line. That is, a predetermined grayscale voltage is applied to a drain electrode of a TFT during a data setup time DS after the gate is turned on, and the same state is maintained for a data holding time DH after the gate is turned off. This makes it possible to write the data voltage Vd in a pixel reliably even if there is a delay in the gate-off timing attributable to rounding of the gate waveform provided that the delay is within the data holding time DH.

However, the greater the panel size of the TFT-LCD, the data holding time DH must be longer. Further, since an output delay time of a data driver increases with the increase of the wiring resistance of the data bus line, the data setup time DS must also increase with the increase of the panel size. On the other hand, an increase in the number of gate bus lines as a result of the trend toward panels with higher definition must be accompanied by a decrease in a horizontal period which is the sum of the data setup time DS and the data holding time DH. That is, in order to satisfy needs for higher definition and greater screen sizes of TFT-LCDs simultaneously, the conventional data driving method must satisfy contradicting requirements for a short horizontal period and a long data holding time DH and data setup time DS.

A normal SVGA (which has 800×600 pixels) and XGA (which has 1024×768 pixels) have horizontal periods of 26.4 μs (microseconds) and 20.7 μs, respectively. Therefore, no shortage of data writing time will occur during normal driving as shown in FIG. 20 in which a gate is turned on once in one frame in the case of panels with definition on the level of XGAs having a screen size of 15 inches in the diagonal direction. However, in the case of screens having definition equivalent to or higher than that of an SXGA (which has 1280×1024 pixels) and screen sizes in the excess of 15 inches in the diagonal direction, normal driving may not allow grayscale data to be satisfactorily written. For example, while a normal SXGA must have a horizontal period of 15.6 μm, an SXGA panel having a screen size in the range from about 17 to 18 inches and utilizing the dot inversion driving method to be described later requires a data holding time DH of 3 μs or more and a data setup time DS of 10 μs or more. Therefore, a sufficient margin for data writing may not be provided.

Under such circumstances, a technique has been used in which writing of display data of interest is preceded by pre-writing of display data having the same polarity as means for solving display problems such as irregularity of display and flickers attributable to a shortage of writing of a data voltage.

A description will be made on the pre-writing technique with reference to an example of dot inversion driving in which polarities of grayscale data of adjoining pixels (sub-pixels) are inverted in both of the directions of gate bus lines and data bus lines. In the case of dot inversion driving, the polarity of grayscale data written in a certain pixel is the same as that of grayscale data written in a pixel that is connected to the gate bus line preceding that of the pixel of interest by two lines on the same data bus line. Therefore, pre-writing to the pixel of interest is performed on the line preceding the line of the pixel of interest, in which the primary data are to be written, by two lines. For example, when grayscale data are written in a pixel on the display starting line (first line), the grayscale data are simultaneously pre-written in a pixel on the third gate bus line counted from the display starting line. After that, the primary grayscale data are written in the pixel on the third gate bus line. Therefore, according to this driving method, the gates on the (n-2)-th line and n-th line counted from the display starting line are simultaneously turned on. For example, driving methods utilizing pre-writing in such a manner are disclosed in Japanese Patent Laid-Open No. 142807/1999 and No. 265411/1993. A possible method for reserving a sufficient margin for data writing without using pre-writing is to perform frame inversion driving to determine data voltages for bus lines earlier. Frame inversion driving is not preferable in that it results in the problem of crosstalk between data bus lines and pixel electrodes.

As described above, pre-writing of data makes it possible to obtain a sufficient margin for writing even in the case of short gate scanning periods as a result of the trend toward TFT-LCDs with higher definition and short data writing times as a result of the trend toward larger screens.

However, in the case of a conventional driving method utilizing pre-writing, e.g., the above-described dot inversion driving, there is no provision for pre-writing for the first line which is the display starting line among gate bus lines and the second line that follows the first line. The pre-writing for the first and second gate bus lines may be performed during or immediately after the display period of the preceding frame or may alternatively be performing in a vertical blanking period.

When the pre-writing of the first and second lines is performed during or immediately after the display period of the preceding frame, false data are continuously displayed during the period between pre-writing in the preceding frame and primary writing in the current frame. When the vertical blanking period is relatively longer than the display period of a frame, the pre-writing for the first and second lines makes boundaries between those lines and other lines clearly recognizable, which results in a problem in that display quality is reduced.

When the pre-writing for the first and second lines is performed during a vertical blanking period, a problem arises in that it involves a complicated process associated with a virtual gate bus line required for starting the pre-writing. When a vertical synchronization signal (Vsync) and a horizontal synchronization signal (Hsync) are input from the system, since the signals Vsync and Hsync indicate the display starting time, the pre-writing can be started at a line which precedes the line, where display is started, by two lines.

However, according to standard specification for recent LCDs, there is a tendency to determine a display position on a screen based on only a data enable signal Enab supplied from a system without using the signals Hsync and Vsync. This results in a problem in that pre-writing for the first and second lines must be performed during a vertical blanking period based on the data enable signal Enab.

SUMMARY OF THE INVENTION

It is an object of the invention to provide a liquid crystal display and a method of driving the same in which pre-writing for at least a first line can be performed in an optimum manner during a vertical blanking period based on a data enable signal Enab from a system.

The above-described object is accomplished by a method of driving a liquid crystal display for controlling timing for outputting display data to a predetermined pixel based on a data enable signal input in association with the input of the display data, characterized in that it has the steps of measuring a period of the data enable signal as a horizontal period, generating a virtual enable signal during a vertical blanking period based on the horizontal period, holding the sum of the data enable signal and virtual enable signal as a vertical period and performing pre-writing of a predetermined display data at least in a pixel at a display starting line at a point in time that precedes the vertical period by an amount which is an integral multiple of the horizontal period.

DETAILED DESCRIPTION OF THE PREFERRED EMBODIMENTS

Figure 1:
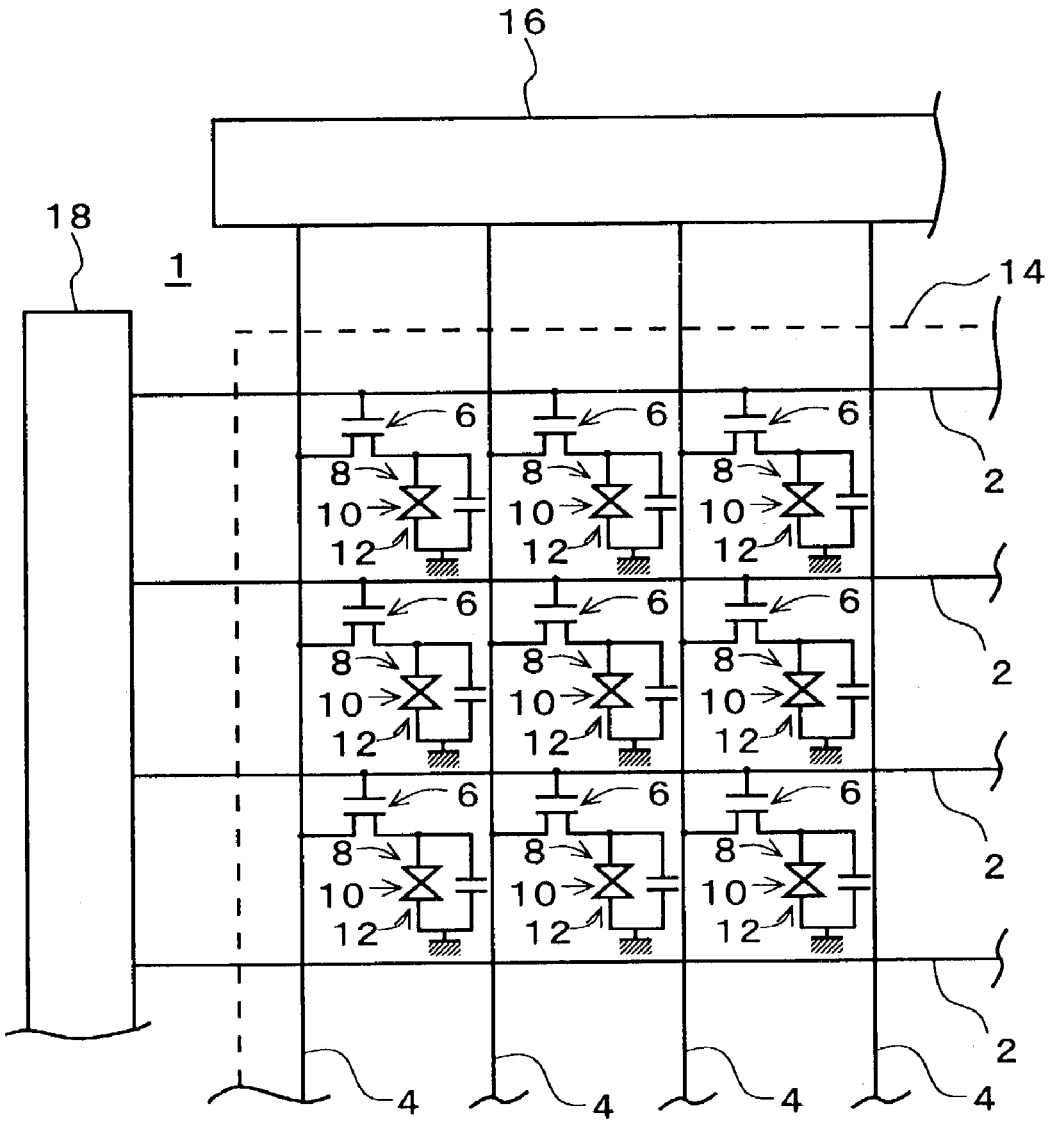
FIG. 1 is an illustration of a schematic configuration of a liquid crystal display according to a first embodiment of the invention.

A description will now be made with reference to FIGS. 1 through 7 on a liquid crystal display and a method of driving the same according to a first embodiment of the invention. First, a brief description will be made with reference to FIG. 1 on a structure of a liquid crystal display utilizing thin film transistors (TFTs) as switching elements as an active matrix liquid crystal display according to the present embodiment. FIG. 1 shows the liquid crystal display as viewed from above a panel thereof. A liquid crystal is enclosed between two glass substrates, i.e., an array substrate 1 and an opposite substrate 14. For example, a plurality of gate bus lines 2 extending in the lateral direction of the figure are formed on the array substrate 1 in a vertically parallel relationship with each other. A plurality of data bus lines 4 extending in the longitudinal direction of the figure are formed in a laterally parallel relationship with each other with an insulation film (not shown) interposed. Each of a plurality of regions in the form of a matrix defined by the gate bus lines 2 and data bus lines 4 formed in the longitudinal and lateral directions serves as a pixel region. FIG. 1 shows an equivalent circuit of the liquid crystal display for each of the pixel regions. A pixel electrode 8 is formed in each of the pixel regions.

A TFT 6 is formed in the vicinity of the intersection between the gate bus line 2 and data bus line 4 at each of the pixel regions, and the gate electrode and drain electrode of the TFT 6 are connected to the gate bus line 2 and data bus line 4, respectively. The source electrode is connected to the pixel electrode 8. The gate bus lines 2 are driven by a gate driver 18, and the data bus lines 4 are driven by a data driver 16. A grayscale voltage is output from the data driver 16 to each data bus line 4. When a gate signal is output to any gate bus line 2, a series of TFTs 6 connected to the gate bus line 2 are turned on. The grayscale voltage is applied to the pixel electrodes 8 connected to the source electrodes of those TFTs 6 to drive a liquid crystal 10 between the pixel electrodes 8 and a common electrode 12 formed on the opposite substrate 14.

Figure 2:
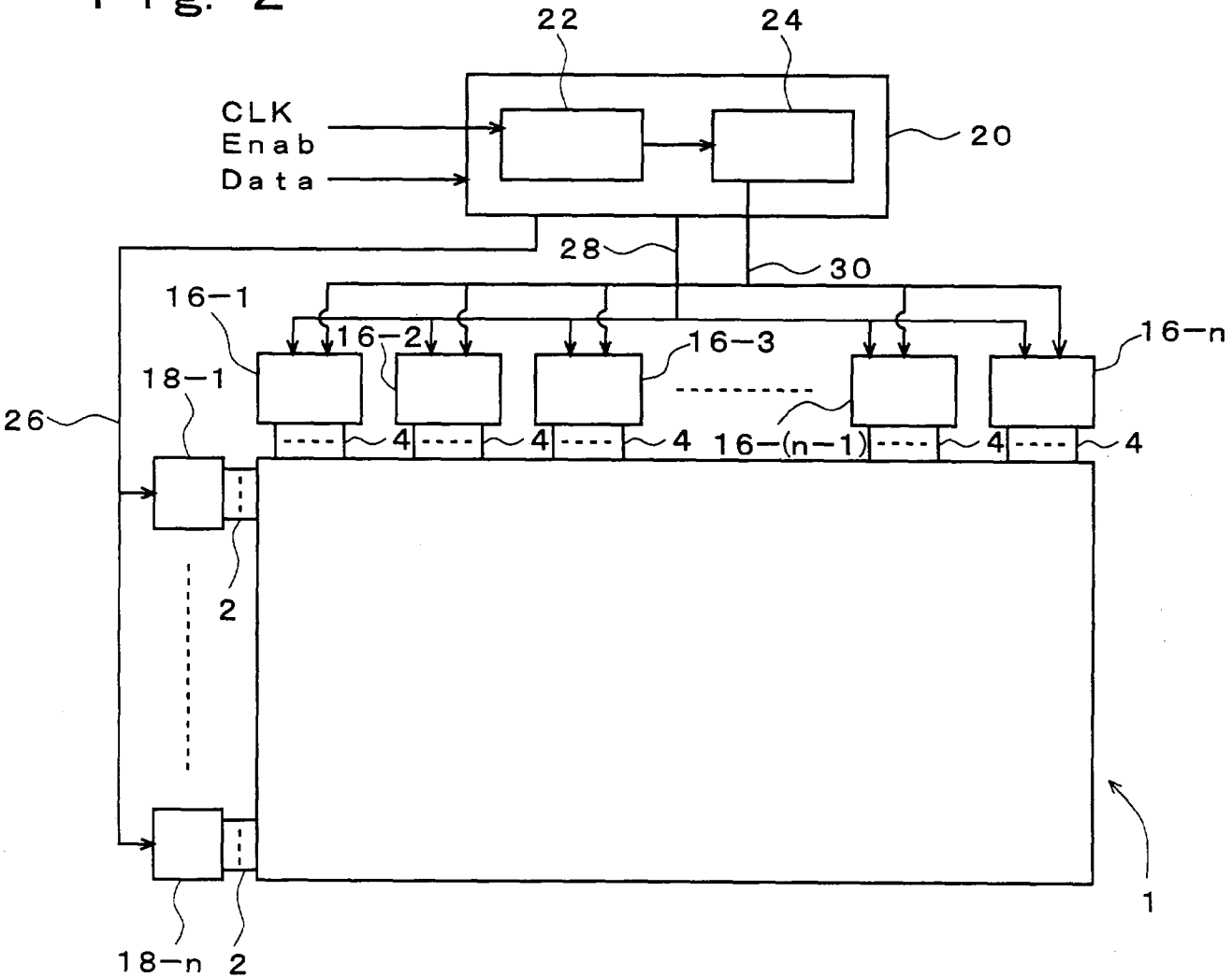
FIG. 2 is an illustration of a schematic configuration of a liquid crystal display in which a display driving method according to the first embodiment of the invention is used.

A schematic configuration of a display driving system of a liquid crystal display according to the present embodiment will now be described with reference to FIG. 2. FIG. 2 shows the liquid crystal display as viewed from above a panel thereof, the configuration of pixels on an array substrate 1 and etc. of the display will not be described because they are the same as those shown in FIG. 1.

As shown in FIG. 2, a plurality of data drivers 16-1 through 16-n (listed in an order starting with the leftmost driver) for respectively outputting data signals to a plurality of data bus lines 4 are connected to the array substrate 1 at the upper side of the panel using, for example, TAB (tape-automated bonding). Similarly, a plurality of gate drivers 18-1 through 18-n (listed in an order starting with the uppermost driver) are provided on the left side of the panel.

A plurality of data bus lines 4 connected to each of the data drivers 16-1 through 16-n are provided such that their distances from the gate drivers 18-1 through 18-n increase in the order of the distances of the data drivers 16-1 through 16-n from the gate drivers. The gate drivers 18-1 through 18-n are connected to a timing controller 20 for outputting gate driver control signals through a signal line 26.

A clock CLK, data enable signals Enab, grayscale data Data, etc. output by a system such as a PC (personal computer) are input to the timing controller 20.

The timing controller 20 has a horizontal counter 22 and a vertical counter 24. The horizontal counter 22 counts the number of dot clocks DCLK generated based on the external clock CLK. The vertical counter 24 counts the number of the data enable signals Enab. Values output by the horizontal and vertical counters 22 and 24 are input to a decoder (not shown) from which various control signals are output.

The timing controller 20 outputs gate clocks GCLK and gate start signals GST as gate driver control signals. The gate clocks GCLK and gate start signals GST are output based on a horizontal period which is obtained by counting the number of dot clocks DCLK from a falling edge (or rising edge; a falling edge will be hereinafter referred to for convenience) of a data enable signal Enab using the counter 22. The gate start signal GST is output based on a vertical period which is obtained by counting the number of data enable signals Enab using the vertical counter 24 because it is normally output once or twice in a particular position of a display frame.

The timing controller 20 outputs the dot clocks DCLK, latch pulses LP, polarity signals POL and data start signals DST as data driver control signals. The latch pulses LP, polarity signals POL and data start signals DST are output based on the above-described horizontal period obtained by the horizontal counter 22. Referring to the recognition of the beginning of a frame, it is determined when the count of the dot clocks DCLK exceeds a predetermined number of clocks during a "L (low)" period of a data enable signal Enab. Those control signals are output to the data drivers 16-1 through 16-n through a control line 30. The grayscale data Data are input to the data drivers 16-1 through 16-n through a data line 28.

A description will now be made with reference to FIGS. 3 through 7 on a method of driving the display of a liquid crystal display according to the present embodiment. While the present embodiment will refer to a pre-writing operation on first and second lines in the case of dot inversion driving as described above, the embodiment may be similarly applied to various other inversion driving methods.

Pre-writing for the first line at the beginning of a display frame and the second line following the same is performed during a vertical blanking period. In order to shorten the display period of the data which are written on a preliminary basis, the pre-writing must be started in a vertical blanking period which is as close as possible to a period in which the first line at the beginning of the display frame is finally written. In the case of dot inversion driving, since the polarities of the data lines change on a cycle of two lines, the start of the pre-writing precedes a leading data enable signal Enab by two horizontal periods.

However, no data enable signal Enab is input from the system during a vertical blanking period. It is therefore necessary to measure and store the length of a vertical blanking period VB and the length of one horizontal period 1H.

Figure 3:
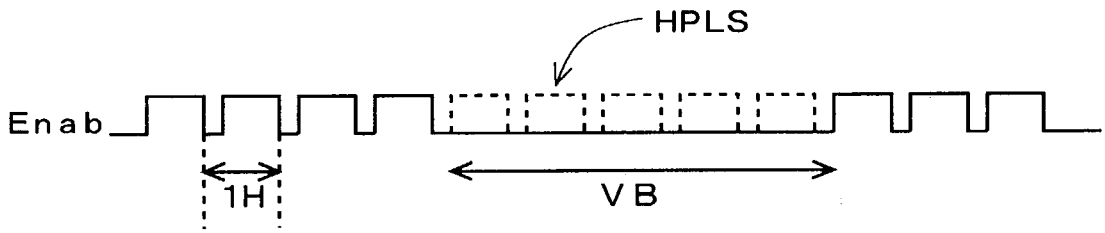
FIG. 3 illustrates a data enable signal Enab input from a system.

FIG. 3 shows a data enable signal Enab that includes a vertical blanking period VB. As shown in FIG. 3, the period between a falling edge of the data enable signal Enab and the next falling edge of the same is one horizontal period 1H. Further, the data enable signal Enab is not output during the vertical blanking period VB.

A position for pre-writing is determined according to the following procedure based on such a data enable signal Enab.

(1) The number of dot clocks DCLK during period between a falling edge of the data enable signal Enab at a certain point in time and the next falling edge using the horizontal counter 22, and the number of dot clocks DCLK associated with one horizontal period 1H is held in a 1H holding circuit (not shown).

During the vertical blanking period VB, the horizontal counter 22 is reset each time the number of dot clocks DCLK counted by the horizontal counter 22 reaches one horizontal period 1H. At the time of resetting, virtual enable signals HPLS (indicated by the broken lines in FIG. 3) are output to the vertical counter 24 instead of falling edges of the data enable signal Enab.

(2) The vertical counter 24 counts the number of data enable signals Enab in one display frame (or the number of horizontal periods 1H) and the number of virtual enable signals HPLS in the vertical blanking period VB. In the case of an SXGA, the number of data enable signals Enab in one frame is 1024, and the number of virtual enable signals HPLS in the vertical blanking period is in the range from about 4 to 42. FIG. 3 shows an example in which the number of HPLS is 5.

Thus, the vertical counter 24 in the present embodiment operates even in a non-display period in order to count the number of virtual enable signals HPLS in the vertical blanking period VB. The sum of the number of data enable signals Enab in one display frame and the number of virtual enable signals HPLS in the vertical blanking period VB is treated as one vertical period 1V and is held in a 1V holding circuit.

Figure 4:
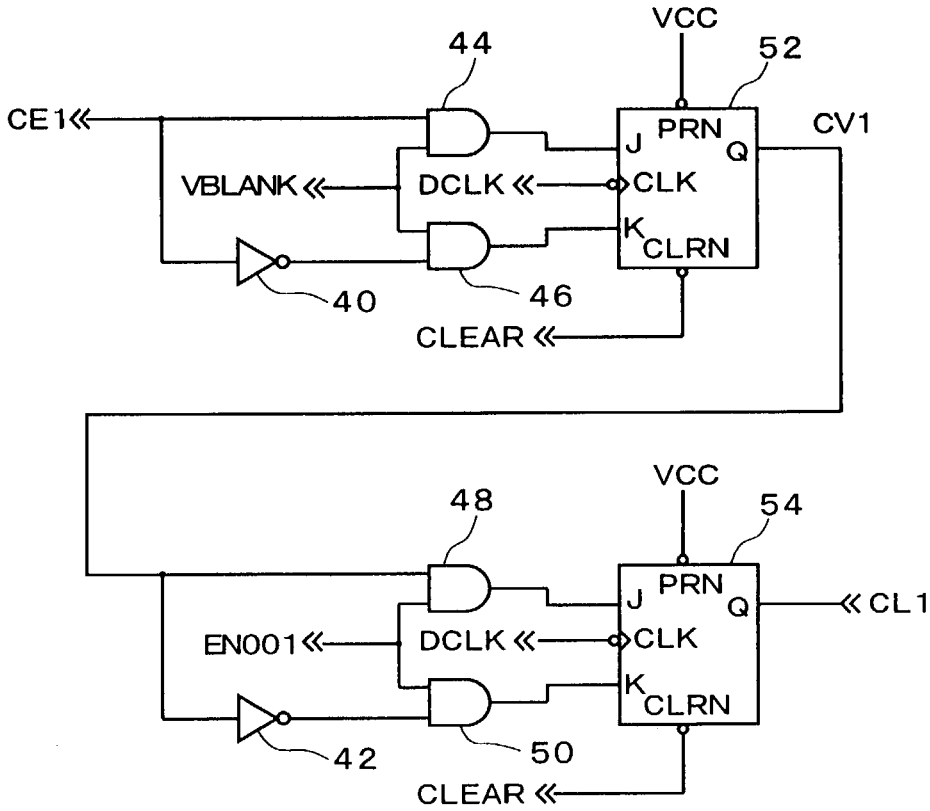
FIG. 4 is an illustration of a vertical period 1V holding circuit used in the method of driving a liquid crystal display according to the first embodiment of the invention.

An example of a configuration of the 1V holding circuit will now be described with reference to FIG. 4. The example of a circuit shown in FIG. 4 represents a circuit for holding a least significant bit in the 1V holding circuit. The 1V holding circuit is formed by providing a plurality of the circuit shown in FIG. 4 in accordance with the number of bits to be hold. In FIG. 4, an output end of a least significant bit CE1 of the vertical counter 24 is connected to one input terminal of a two-input AND circuit 44 and to one input terminal of a two-input AND circuit 46 through an inverter 40. Virtual enable signals HPLS in a vertical blanking period VB are input to the other input terminals of the two AND circuits 44 and 46.

An output terminal of the AND circuit 44 is connected to a J-input terminal of a JK flip-flop (JKFF) 52, and an output terminal of the AND circuit 46 is connected to a K-input terminal of the JKFF 52. The dot clocks DCLK are input to a clock input terminal CLK of the JKFF 52. Such a configuration makes it possible to fetch the value of one vertical period IV from the vertical counter 24 in a vertical blanking period VB and to hold it during the period of the next display frame. A value CV1 of a least significant bit of one vertical period 1V in the preceding frame is output during the period of the next display frame.

A Q-output terminal of the JKFF 52 is connected to one input terminal of a two-input AND circuit 48 and to one input terminal of a two-input AND circuit 50 through an inverter 42. A data hold signal EN001 is input to the other input terminals of the two AND circuits 48 and 50. An output terminal of the AND circuit 48 is connected to a J-input terminal of a JKFF 54, and an output terminal of the AND circuit 50 is connected to a K-input terminal of the JKFF 54. The dot clocks DCLK are input to a clock input terminal CLK of the JKFF 54.

Such a configuration makes it possible to hold the value of one vertical period 1V fetched from the vertical counter 24 during a vertical blanking period VB during the next vertical period (the period of the next display frame and vertical blanking period). A value CL1 of a least significant bit of the sum of the number of horizontal periods 1H and the number of virtual enable signals HPLS in the preceding vertical period is held during the next vertical period at the Q-output terminal of the JKFF 54.

A 1H holding circuit which is connected to the horizontal counter 22 can be provided with a similar circuit configuration, although not shown.

Figure 5:
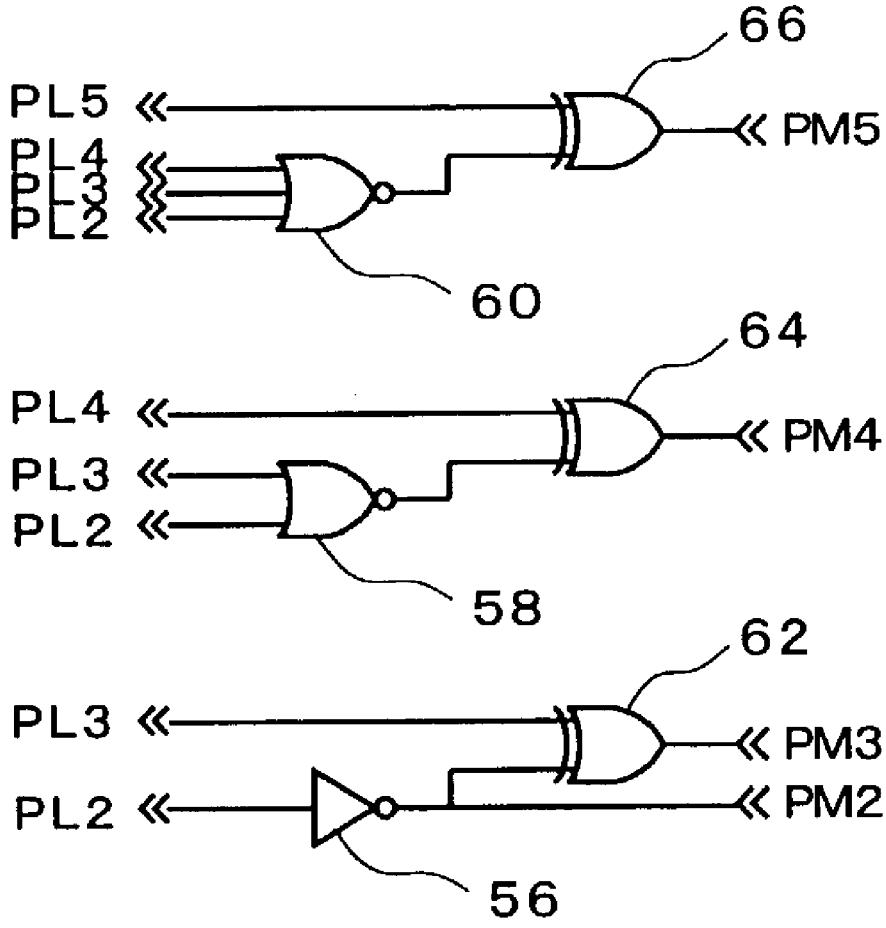
FIG. 5 is an illustration of a subtraction circuit used in the method of driving a liquid crystal display according to the first embodiment of the invention.

(3) Next, the number of lines required for performing pre-writing in the vertical blanking period VB is subtracted from the sum of the number of the horizontal periods 1H and the number of vertical enable signals HPLS in one vertical period held in the 1V holding circuit. This is carried out by a subtraction circuit an example of which is shown in FIG. 5. FIG. 5 shows a circuit for performing a process of subtracting "2" from the value held in the 1V holding circuit in order to start pre-writing at a point in time that precedes final writing of data in the first line at which display is started by two horizontal periods. The subtraction circuit shown in FIG. 5 subtract the count value of vertical periods output by the 1V holding circuit described with reference to FIG. 4 by performing a predetermined process on the second through fifth low order bits of the count value.

Referring to FIG. 5, an input end PL2 is connected to an output end PM2 through an inverter 56 and is connected to one input terminal of an exclusive OR circuit (EXOR circuit) 62. Further, the input end PL2 is connected to one input terminal of a two-input NOR circuit 58 and a first input terminal of a three-input NOR circuit 60. An input end PL3 is connected to the other input terminal of the EXOR circuit 62, the other input terminal of the two-input NOR circuit 58 and a second input terminal of the three-input NOR circuit 60. An input end PL4 is connected to one input terminal of an EXOR circuit 64 and a third input terminal of the NOR circuit 60. An input end PL5 is connected to one input terminal of an EXOR circuit 66.

An output terminal of he NOR circuit 58 is connected to another input terminal of the EXOR circuit 64. An output terminal of the NOR circuit 60 is connected to another input terminal of the EXOR circuit 66. An output terminal of the EXOR circuit 62, an output terminal of the EXOR circuit 64 and an output terminal of the EXOR circuit 66 are connected to the output ends PM3, PM4 and PM5, respectively.

When values D2 through D5 shown in Table 1 are input to the input ends PL2 through PL5 of the circuit having such a configuration as the values of the second through fifth low order bits of the count value of the vertical periods from the 1V holding circuit described with reference to FIG. 4, values Q2 through Q5 shown in Table 2 are output at the output ends PM2 through PM5. "X" in Table 1 represents "1" or "0".

TABLE 1

| D2 | D3 | D4 | D5 |
|---|---|---|---|
| 1 | X | X | X |
| 0 | 1 | X | X |
| 0 | 0 | 1 | X |
| 0 | 0 | 0 | 1 |

TABLE 2

| Q2 | Q3 | Q4 | Q5 |
|---|---|---|---|
| 0 | D3 | D4 | D5 |
| 1 | 0 | D4 | D5 |
| 1 | 1 | 0 | D5 |
| 1 | 1 | 1 | 0 |

Thus, a point in time that precedes final writing of data on the first line which is a display starting line by two horizontal periods can be determined as the time to start pre-writing.

According to the present embodiment, there is thus provided the horizontal counter 22 which is reset at each period of one data enable signal Enab, or at each horizontal period and the vertical counter 24 which counts the sum of data enable signals Enab and virtual enable signals HPLS to determine a vertical period. Therefore, a gate start signal GST can be output at a predetermined point in time in a vertical blanking period based on the horizontal period and vertical period. While the number of horizontal periods in each display frame is preferably constant, no problem arises because the number is normally kept at a constant value under control of a PC or the like at a system.

Figure 6:
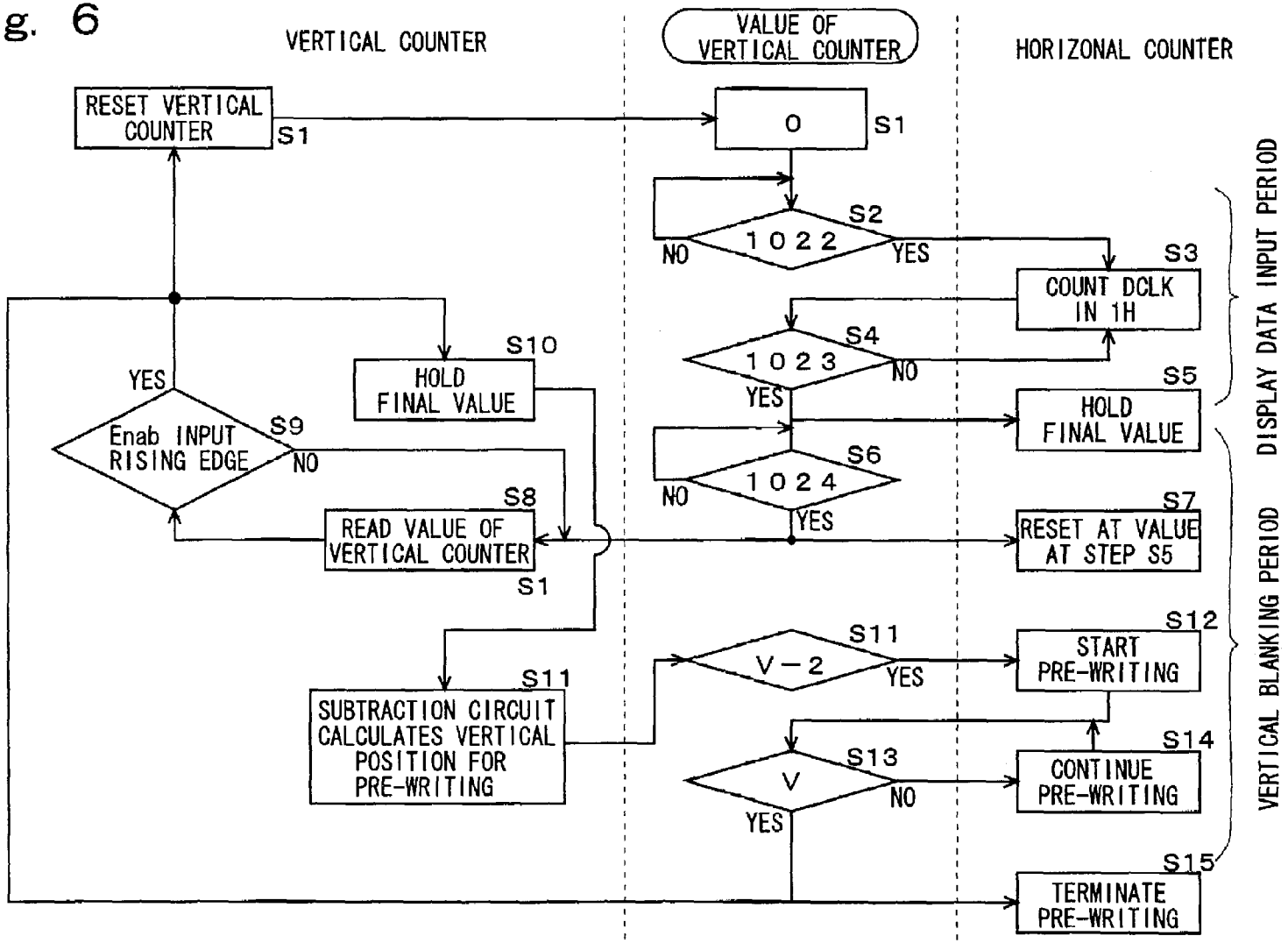
FIG. 6 primarily illustrates operating steps of a horizontal counter 22 and a vertical counter 24 used in the method of driving a liquid crystal display according to the first embodiment of the invention.
Figure 7:
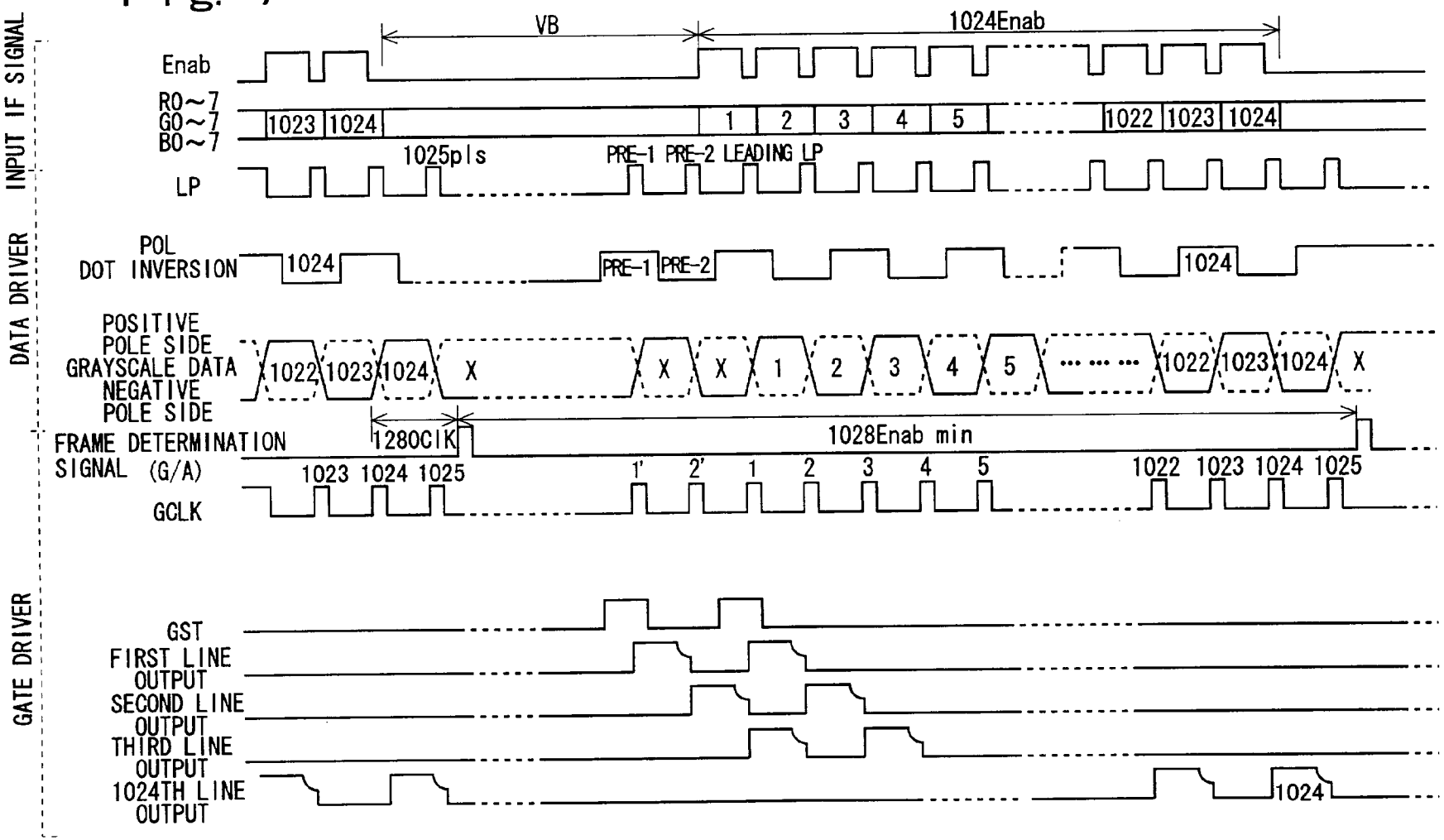
FIG. 7 is a timing chart for explaining the method of driving a liquid crystal display according to the first embodiment of the invention.

The method of driving a liquid crystal display according to the present embodiment will now be described in more detail with reference to FIGS. 6 and 7. FIG. 6 shows operations of the horizontal counter 22 and vertical counter 24 at timing of operation shown in FIG. 7. FIG. 7 is a timing chart for an application of the present embodiment to a liquid crystal display which is an SXGA and which employs dot inversion driving.

In the example shown in FIGS. 6 and 7, there are 1024 (H) display frames and 6 (H) vertical blanking periods VB, although not shown. As described above, the vertical counter 24 operates even in a vertical blanking period VB to count data enable signals Enab and virtual enable signals HPLS. Therefore, the value of the vertical counter increases up to 1030 in the example shown in FIG. 6. The vertical counter 24 is reset at the input of a leading data enable signal Enab after the vertical blanking period VB (see step S1). The switching of display frames is determined from the length of the "L" period of the data enable signal Enab.

In the present embodiment, as shown at steps S2 through S5 in FIG. 6, the horizontal counter 22 starts measuring one horizontal period 1H when the count value of the vertical counter 24 reaches 1022. The measurement of one horizontal period 1H is carried out by counting the number of dot clocks DCLK generated between the falling edge of the data enable signal Enab located in the 1022nd place counted from a leading data enable signal Enab and the falling edge of the 1023rd data enable signal Enab. The measured one horizontal period 1H is held in a 1H holding circuit which has a circuit configuration similar to that shown in FIG. 4.

Next, the horizontal counter 22 is reset at step S6 upon the input of the 1024th data enable signal Enab, and the horizontal counter 22 is thereafter reset each time the number of dot clocks DCLK counted by the horizontal counter 22 reaches the one horizontal period 1H held at step S5 (step S7). Accordingly, virtual enable signals HPLS are output in a vertical blanking period VB.

After counting the 1024 data enable signals, the vertical counter 24 subsequently counts the virtual enable signals HPLS. At this time, the count value of the vertical counter 24 is read in the 1V holding circuit shown in FIG. 4 at the timing of the input of the virtual enable signals HPLS (step S8).

The counting of the virtual enable signals HPLS by the vertical counter 24 and the reading of the count value of the vertical counter 24 by the 1V holding circuit are terminated when a rising edge of a data enable signal Enab is detected (step S9).

When the rising edge of the data enable signal Enab is detected, a vertical period 1V is held in the 1V holding circuit shown in FIG. 4 (step S10), and the vertical counter 24 is reset (step S1).

The vertical period 1V held in the 1V holding circuit is output to the subtraction circuit shown in FIG. 5 in which two horizontal periods are subtracted from the same to calculate a vertical position for pre-writing (step S11). In the present embodiment, pre-writing in the pixel on the first line which is the display starting line in the next screen is performed at a point which is shorter in time by twice the amount of horizontal period 1H than the vertical period 1V after the time of input of the leading data enable signal Enab.

Then, pre-writing in the pixel on the second line in the next screen is performed at a point which is shorter in time by one horizontal period 1H than the vertical period 1V after the time of input of the leading data enable signal Enab (step S12). That is, the time of pre-writing for the first line which is the display starting line in the next screen precedes the time of final writing to the first line by two horizontal period 1H. Then, the time of pre-writing for the second line in the next screen precedes the time of final writing to the second line by two horizontal period 1H.

The count value of the vertical counter 24 is incremented each time pre-writing is performed, and it is determined at step S13 whether the count value has returned to the vertical period 1V. If not, pre-writing is continued (step S14), and pre-writing is terminated when the count value of the vertical counter 24 reaches the vertical period 1V (step S15). Pre-writing is also terminated when a leading data enable signal Enab is detected at step S9 (step S15).

As shown in FIG. 7, when pre-writing is performed, a gate start signal GST is transmitted from the timing controller 20 to the gate driver 18, and gate clocks GCLK are subsequently output to the gate driver 18. The gate driver 18 starts operating at the gate start signal GST and sequentially closes open gates each time a gate clock GCLK is input and opens gates on the next line. Dot clocks DCLK, latch pulses LP and polarity signals POL similar to the control signals in a display frame are output to the data driver 16. The polarity signals POL control the output polarity of the data driver, and the polarity signal POL for each line is inverted in each frame.

A frame determination signal shown in FIG. 7 is a signal which is used to determine the end of a frame when the "L" period of data enable signal Enab has reached a predetermined number of dot clocks DCLK and the number of lines has reached 1024, i.e., when the input number of data enable signals Enab is 1024. When the number of data enable signals Enab is smaller than this number, up to the 1024th line are operated according to internal timing. When the same number is exceeded, such excess data enable signals Enab are invalidated.

Grayscale data output by the data driver 16 shown in FIG. 7 are set such that pixels (collections of R-, G- and B-subpixels) are displayed in black. This makes it possible to minimize variation of average luminance of lines in one frame on which pre-writing is performed in a vertical blanking period. Display in black only results in a reduction of luminance that is the display time of data for pre-writing divided by one vertical period. In the case of dot inversion driving according to the invention, the reduction is 2/1030 which creates no problem associated with visibility. The polarity of data for pre-writing is the same as the polarity at the time of writing primary data.

As described above, the present embodiment makes it possible to eliminate insufficient writing throughout a screen and variation of a particular line without any significant increase in the scale of the circuit of a timing controller.

The present invention is not limited to the above-described embodiment, and various modifications are possible.

For example, pre-writing is started in a position that precedes a leading data enable signal Enab by two horizontal periods in the above-described embodiment because the embodiment refers to an example of dot inversion driving in which the polarities of data lines change at a cycle of two lines. For example, when the present invention is applied to two-dot inversion driving, since the polarities of data lines change at a cycle of four lines, pre-writing may be started in a position that precedes a leading data enable signal Enab by four horizontal periods. When the present invention is applied to frame inversion driving, since the polarities of data lines are kept unchanged during one frame period, pre-writing may be started in a position that precedes a leading data enable signal Enab by one horizontal period.

A liquid crystal display according to a second embodiment of the invention will now be described with reference to FIGS. 8 through 19. The above-described first embodiment relies upon the use of a pre-writing type driving method in order to mitigate any shortage of writing of data in pixel electrodes that may occur as a result of the trend toward liquid crystal displays with greater screens and higher definition. On the contrary, the liquid crystal display according to the present embodiment can be implemented independently of the pre-writing method. It is obvious that the pre-writing method may be used in the present embodiment.

When it is attempted to increase the number of the display pixels of the liquid crystal display according to the first embodiment shown in FIGS. 1 and 2, there is a need for finer gate bus lines 2, an increase in the number of wirings, expansion of the wiring length and the like, which results in increases in the resistance and load capacitance of the gate bus lines 2 to cause a gate delay. A significant gate delay can cause irregularity of luminance in the lateral direction of the display screen.

Figure 8:
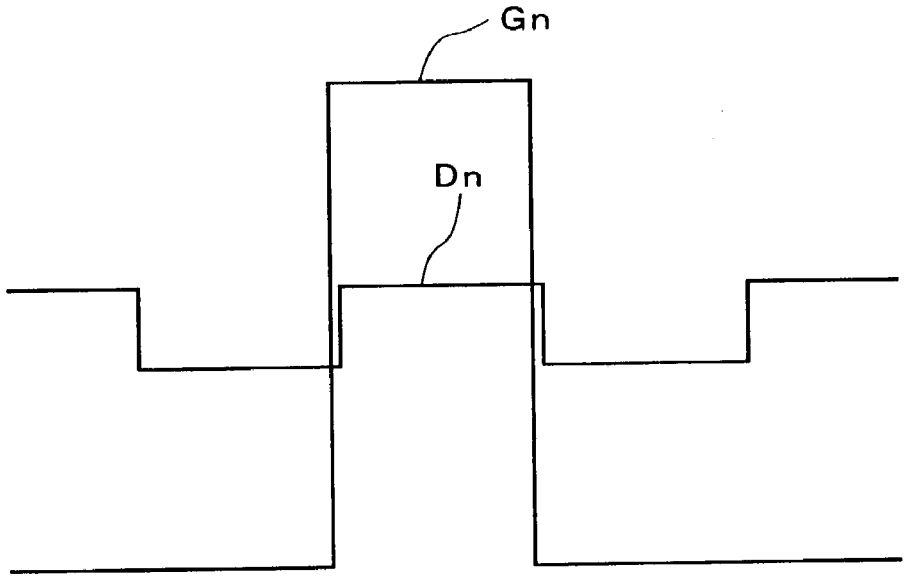
FIG. 8 is a diagram for explaining a gate delay.

FIG. 8 shows a gate signal Gn and a data signal (grayscale signal) Dn which are input to a TFT 6 located in a position near the gate driver 18 of the gate bus lines 2 shown in FIG. 2. The horizontal direction of the figure represents time, and the vertical direction represents signal levels. Since there is no gate delay in the state shown in FIG. 8, the gate signal Gn on the gate bus line 2 is in a rectangular shape. Since the gate of the TFT 6 is therefore turned off during a time in which the data signal Dn is output to the data bus line 4 according to predetermined data output timing, it is possible to write the data in the pixel electrode 8 accurately.

Figure 9:
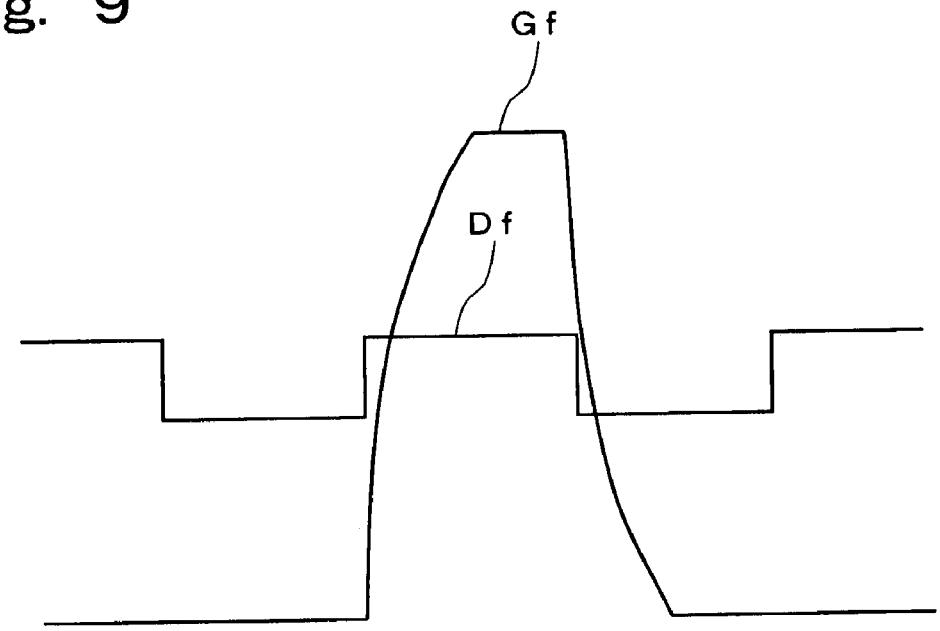
FIG. 9 is a diagram for explaining a gate delay.

FIG. 9 shows a gate signal Gf and a data signal Df input to a TFT 6 located in a position apart from the gate driver 18 of the gate bus lines 2 shown in FIG. 2. There is a gate delay in the state shown in FIG. 9, and the gate signal Gf on the gate bus line 2 is rounded. Therefore, even if the data signal Df is output to the data bus line 4 at the same data output timing as that for the data signal Dn shown in FIG. 8, the TFT 6 is turned off with a delay that corresponds to the rounding of the gate signal Gf. As a result, inaccurate data which is different from the original level of the data signal Df is written in the pixel electrode 8. The rounding of the gate signal Gf makes the gate-off time of the TFT 6 longer than one horizontal period 1H, which becomes more significant with the distance from the gate driver 18.

Figure 10:
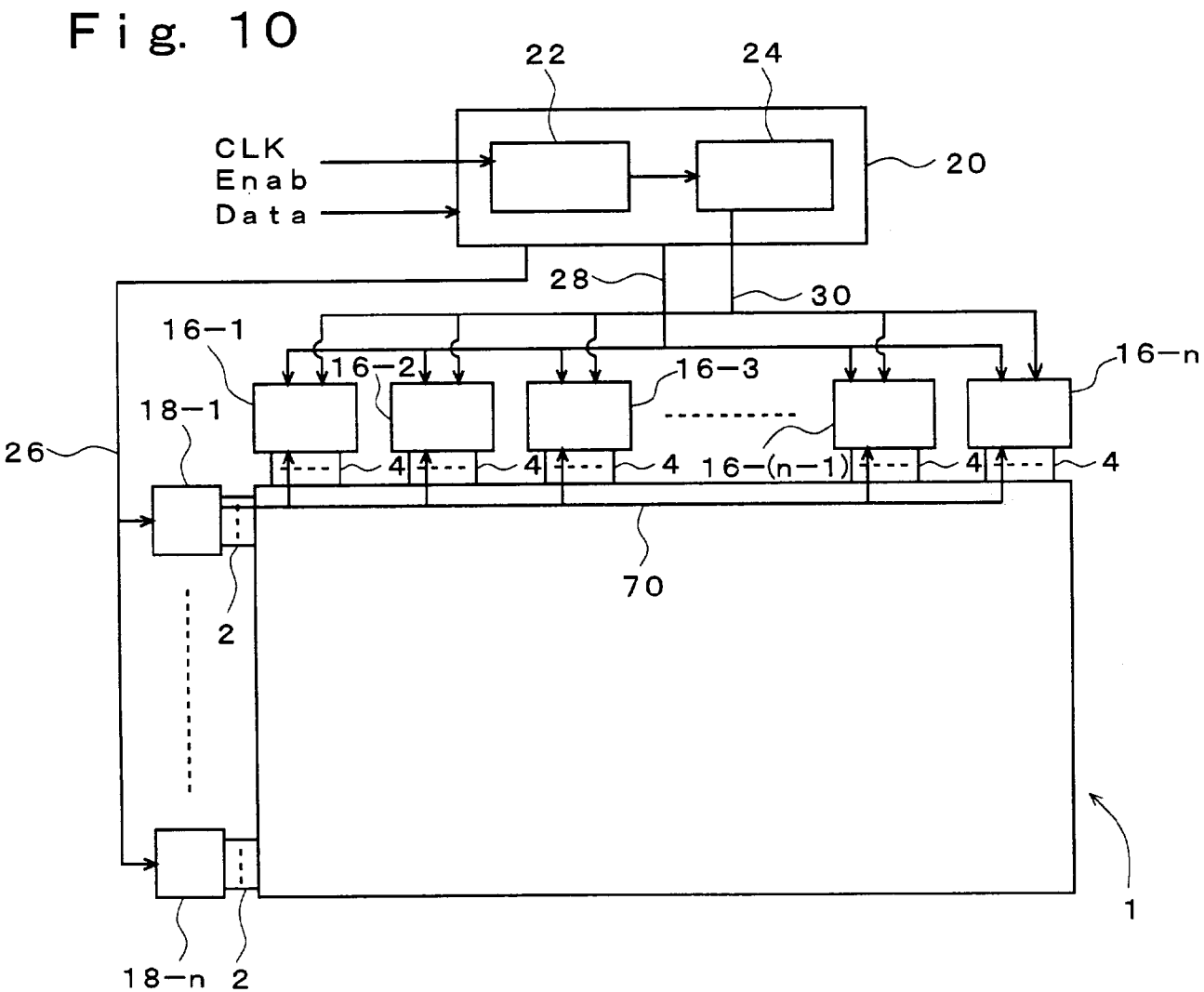
FIG. 10 is an illustration of a schematic configuration of a liquid crystal display according to a second embodiment of the invention.

In the present embodiment, a configuration shown in FIG. 10 is employed to allow sufficient writing of a data signal in a pixel electrode even if there is rounding of the gate signal. FIG. 10 shows a schematic configuration of a liquid crystal display according to the present embodiment. In the present embodiment, components having the same functions and operations as those in the configuration shown in FIGS. 1 and 2 used in the first embodiment are indicated by like reference numbers and will not be described.

A TFT-LCD 1 shown in FIG. 10 is characterized in that a latch pulse supply line 70 is provided unlike the TFT-LCD shown in FIGS. 1 and 2. For example, the latch pulse supply line 70 is extracted from a gate driver 18-1 and is provided above the gate bus line 2 which is the uppermost gate bus line in the figure substantially in parallel with the gate bus line 2. Branch lines branched in the middle of the latch pulse supply line 70 are respectively wired to data drivers 16-1 through 16-n. Latch pulses LP are supplied from the timing controller 20 to the latch pulse supply line 70 through the gate driver 18-1 and a control line 26. Dot clocks DCLK, polarity signals POL, data start signals DST, etc. other than the latch pulses PL are output to the control line 30.

Therefore, the latch pulses LP of the TFT-LCD1 of the present embodiment are output from the timing controller 20 to the latch pulse supply line 70 through the control line 26 and gate driver 18-1. The latch pulses LP are sequentially supplied from the branch lines connected to the latch pulse supply line 70 to data drivers 16-1 through 16-n. The latch pulse supply line 70 has a line width and length substantially similar to those of the gate bus lines 2 and is provided in parallel with the gate bus lines 2. This makes it possible to generate rounding of a waveform similar to gate rounding on the latch pulses LP input to the data drivers 16-1 through 16-n.

Figure 11:
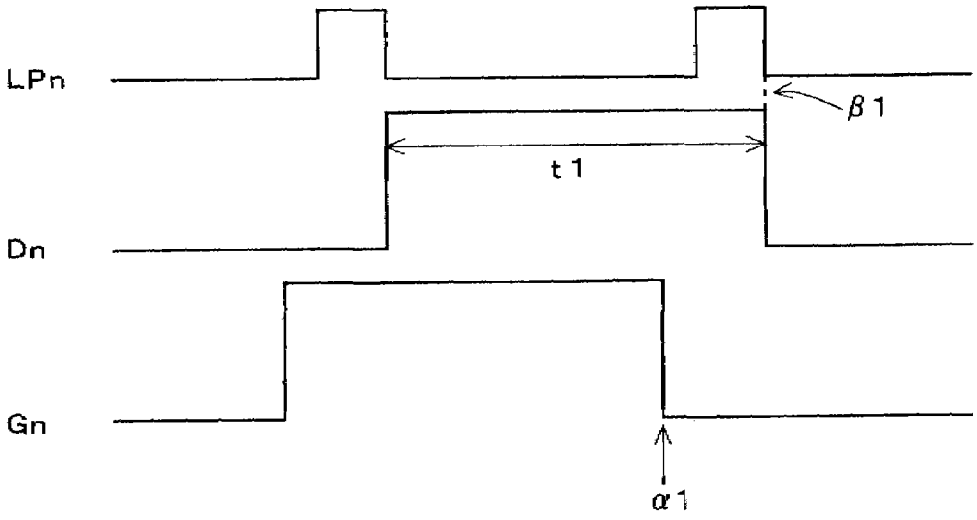
FIG. 11 is a timing chart for explaining a method of driving a liquid crystal display according to the second embodiment of the invention.

The upper part of FIG. 11 shows a latch pulse LPn which is input from the latch pulse supply line 70 to a data driver 16 located in a position near the gate driver 18. In the middle of FIG. 11, there is shown a data signal Dn which is output in synchronism with a falling edge of the latch pulse LPn shown in the upper part of FIG. 11. The lower part of FIG. 11 shows a gate signal Gn which is input to a TFT 6 in a position near the gate driver 18 of the gate bus lines 2. The horizontal direction of the figure represents time, and the vertical direction represents signal levels. There is no gate rounding attributable to a gate delay in the state shown in FIG. 11, and there is no waveform rounding on the latch pulse LPn. When the latch pulse LPn causes the data signal Dn to be output to the data bus line 4, the gate of the TFT 6 is turned off (as indicated by $\alpha$1 in the figure) in an output period t1 of the data signal Dn before a data switching time (as indicated by $\beta$1 in the figure), which allows the data to be accurately written in the pixel electrode 8.

Figure 12:
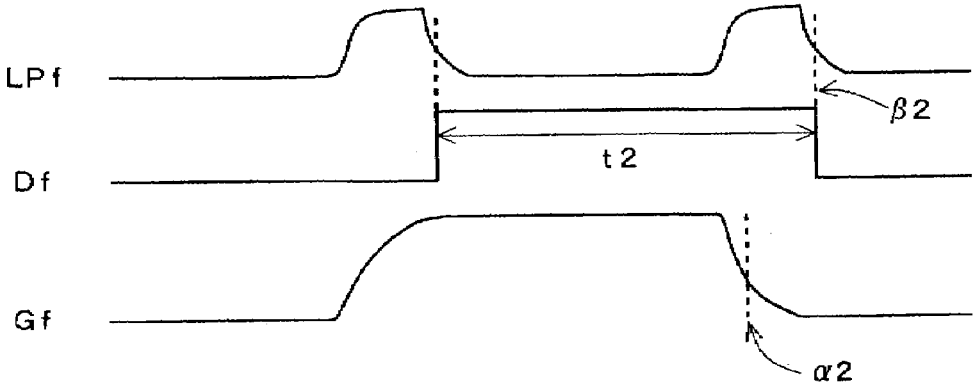
FIG. 12 is a timing chart for explaining a method of driving a liquid crystal display according to the second embodiment of the invention.

The upper part of FIG. 12 shows a latch pulse LPf which is input from the latch pulse supply line 70 to a data driver 16 located in a position apart from the gate driver 18. In the middle of FIG. 12, there is shown a data signal Df which is output at the latch pulse LPf shown in the upper part of FIG. 12. The lower part of FIG. 12 shows a gate signal Gf which is input to a TFT 6 in a position apart from the gate driver 18 of the gate bus lines 2. There is a gate delay in the state shown in FIG. 12, and the gate signal Gf on the gate bus line 2 is rounded. In synchronism with the same, the latch pulse LPf has a delay and the waveform of the same is rounded accordingly. Therefore, there is a delay in the output timing of the data signal Df which is output based on the latch pulse LPf having a delay. Since the delay in the output of the data signal Df causes the gate of the TFT 6 to be turned off in an output period t2 of the data signal Df (as indicated by $\alpha$2 in the figure) before the switching of the data signal Df (as indicated by $\beta$2 in the figure), the data can be accurately written in the pixel electrode 8 in spite of the fact that a gate delay has occurred.

Thus, the latch pulses LP are output from the gate driver 18 to the liquid crystal panel similarly to gate signals, and the latch pulses LP are sequentially input to the data drivers 16 with waveform rounding similar to gate rounding attributable to a gate delay. This makes it possible to shift outputs of data signals in accordance with gate rounding. This makes it possible to eliminate irregularity of display of a liquid crystal display having a high definition and a large screen, thereby allowing display with high image quality.

A modification of the liquid crystal display according to the present embodiment will now be described with reference to FIGS. 13 through 19. In this modification, sequential shifts are again introduced in the output timing of data signals in accordance with rounding of a gate waveform attributable to a gate delay instead of outputting the data signals simultaneously from all of data drivers 16.

Figure 13:
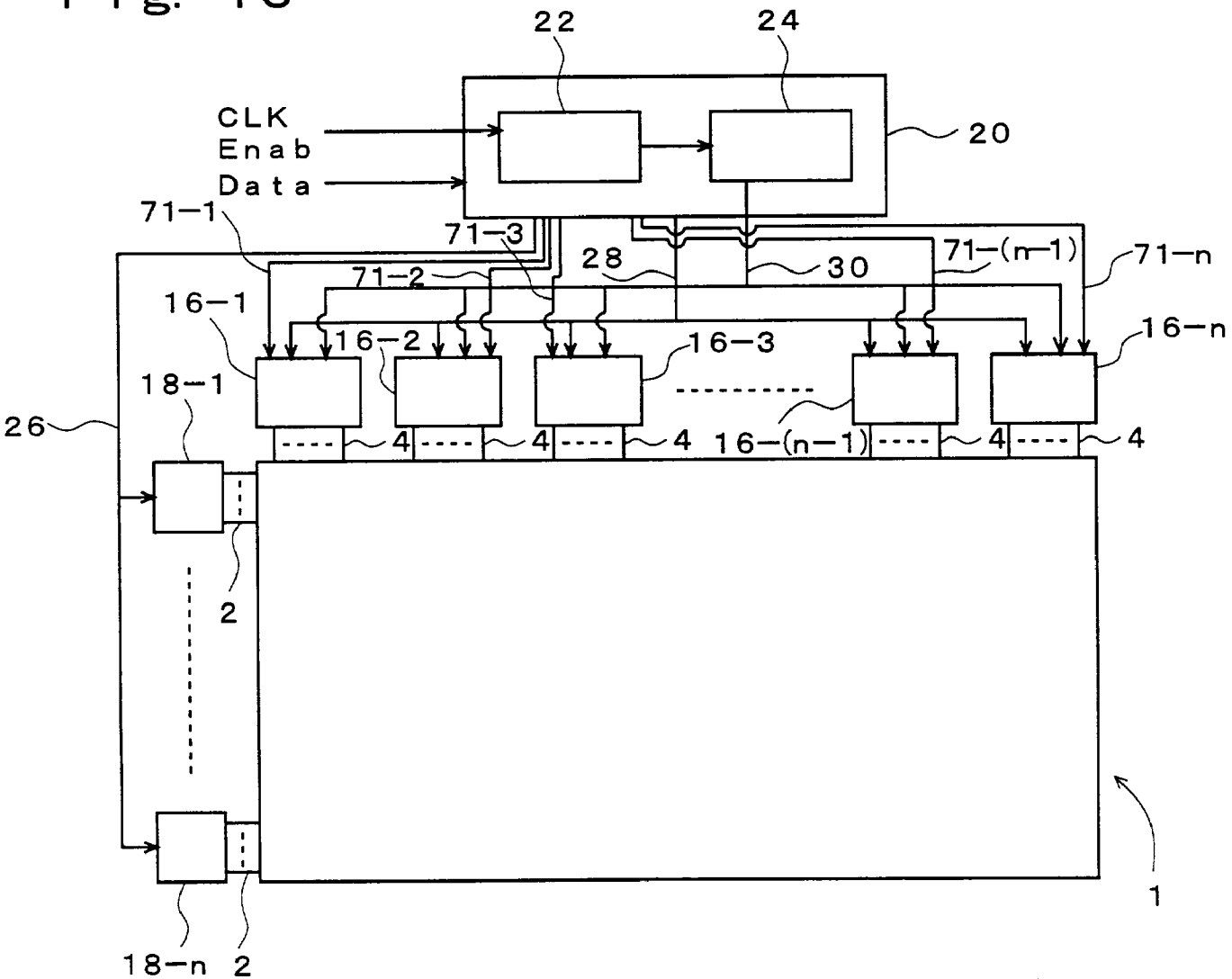
FIG. 13 is an illustration of a schematic configuration of a liquid crystal display according to a modification of the second embodiment of the invention.

A TFT-LCD 1 shown in FIG. 13 is characterized in that latch pulse supply lines 71-1 through 71-n are respectively wired to data drivers 16-1 through 16-n instead of the latch pulse supply line 70 in the TFT-LCD1 shown in FIG. 10. Latch pulses LP-1 through LP-n which are sequentially shifted in the output timing in accordance with a gate delay in the timing controller 20 are supplied to the latch pulse supply lines 71-1 through 71-n, respectively. Therefore, data signals can be output in accordance with the gate delay.

Figure 14:
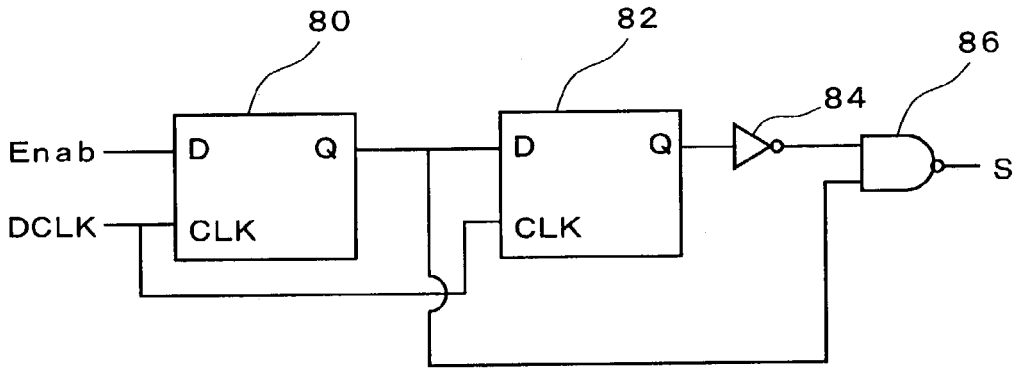
FIG. 14 is an illustration of a schematic configuration of a latch pulse generation circuit of the liquid crystal display according to the modification of the second embodiment of the invention.
Figure 15:
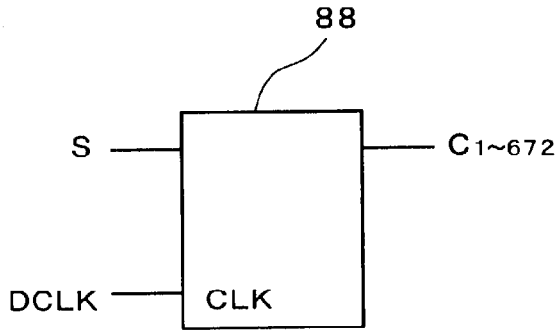
FIG. 15 is an illustration of a schematic configuration of the latch pulse generation circuit of the liquid crystal display according to the modification of the second embodiment of the invention.
Figure 16:
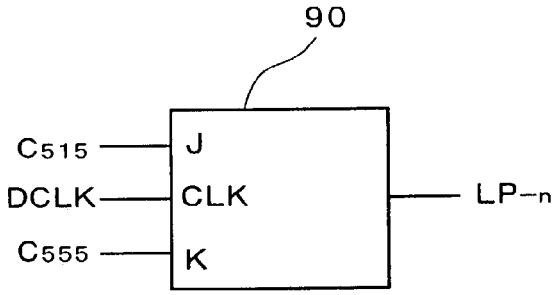
FIG. 16 is an illustration of a schematic configuration of the latch pulse generation circuit of the liquid crystal display according to the modification of the second embodiment of the invention.
Figure 17:
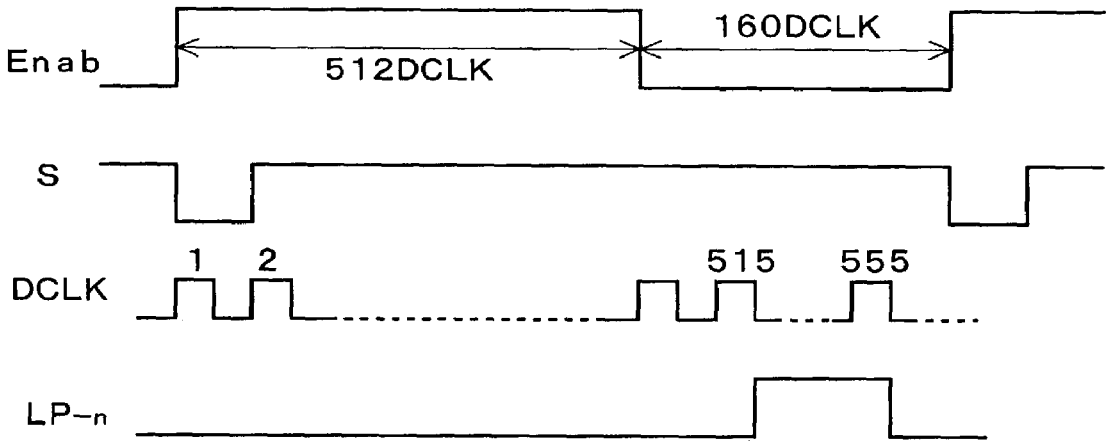
FIG. 17 is a timing chart showing the operation of the latch pulse generation circuit of the liquid crystal display according to the modification of the second embodiment of the invention.

A latch pulse generation circuit provided in the timing controller 20 will now be described with reference to FIGS. 14 through 17. FIGS. 14 through 16 show a schematic configuration of the latch pulse generation circuit, and FIG. 17 is a timing chart for various signals in the same circuit.

As shown in FIG. 14, the latch pulse generation circuit has a D-flip-flop (DFF) 80 to which a data enable signal Enab is input at an input terminal thereof. As shown in FIG. 17, the data enable signal Enab has 512 dot clocks in a period during which the signal Enab is in a "H (high)" state and has 160 dot clocks in a period during which the signal Enab is in a "L (low)" state. Therefore, there are 672 dot clocks between a rising edge of the data enable signal Enab and the next rising edge of the same.

Referring again to FIG. 14, dot clocks DCLK are input to a clock input terminal of the DFF 80. An output terminal of the DFF 80 is connected to an input terminal of a DFF 82 on the next stage and is connected to one input terminal of a two-input NAND circuit. The dot clock DCLK are input to a clock input terminal of the DFF 82. An output terminal of the DFF 82 is connected to an inverter 84, and an output terminal of the inverter 84 is connected to the other input terminal of the two-input NAND circuit 86. With such a configuration, an Enab detection signal S which rises in synchronism with a rising edge of the data enable signal Enab as shown in FIG. 17 is output at an output terminal of the NAND circuit 86. As shown in FIG. 15, the Enab detection signal S is input to a counter 88 for counting the number of dot clocks DCLK. The counter 88 is reset each time an Enab detection signal S is input to count the number of dot clocks DCLK.

Count values C1 through C672 output by the counter 88 are input to a decoder which is not shown. When predetermined count values are encountered, the decoder outputs pulses to a J- or K-input terminal of a JKFF 90 shown in FIG. 16. For example, it inputs a pulse to the J-input terminal of the JKFF 90 when the count value becomes C515 and inputs a pulse to the K-input terminal when the count value subsequently becomes C555. Thus, as shown in FIG. 17, a latch pulse LP-n can be output from an output terminal of the JKFF 90 shown in FIG. 16 between a rise of a data enable signal Enab and the next rise of the same, i.e., during a period between 515/672 and 555/672 of one horizontal period. Latch pulses LP-1 through LP-n which are sequentially shifted in the output timing thereof can be supplied by controlling the timing of the input of pulses to the J- and K-input terminals of the JKFF 90 from the decoder in accordance with a gate delay.

Figure 18:
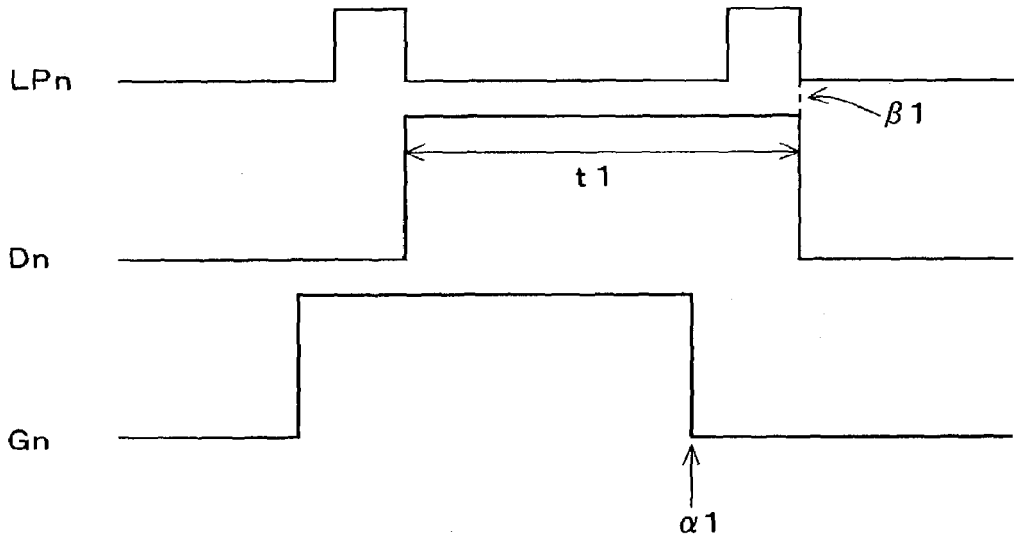
FIG. 18 is a timing chart for explaining a method of driving a liquid crystal display according to a modification of the second embodiment of the invention.

The upper part of FIG. 18 shows a latch pulse LPn which is input from among the latch pulse supply lines 71-1 through 71-n to a data driver 16 located in a position near the gate driver 18. In the middle of FIG. 18, there is shown a data signal Dn which is output in synchronism with a falling edge of the latch pulse LPn shown in the upper part of FIG. 18. The lower part of FIG. 18 shows a gate signal Gn which is input to a TFT 6 in a position near the gate driver 18 of the gate bus lines 2. The horizontal direction of the figure represents time, and the vertical direction represents signal levels. There is no gate rounding attributable to a gate delay in the state shown in FIG. 18, and there is no waveform rounding on the latch pulse LPn. When the latch pulse LPn causes the data signal Dn to be output to the data bus line 4, the gate of the TFT 6 is turned off (as indicated by al in the figure) in an output period t1 of the data signal Dn before a data switching time (indicated by β1 in the figure), which allows the data to be accurately written in the pixel electrode 8.

Figure 19:
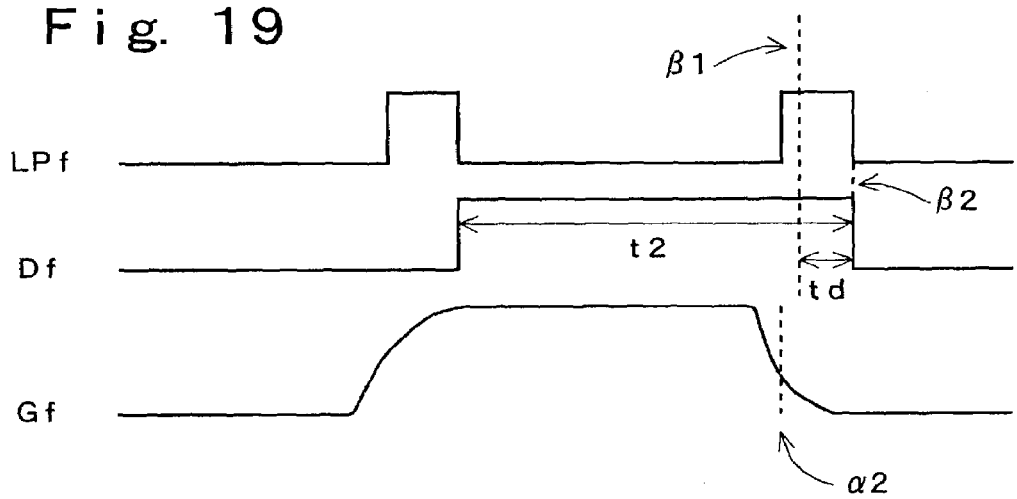
FIG. 19 is a timing chart for explaining a method of driving a liquid crystal display according to a modification of the second embodiment of the invention.
Figure 20:
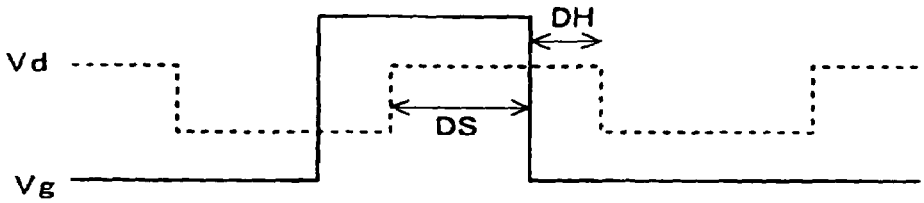
FIG. 20 is an illustration for explaining a conventional method of driving a liquid crystal display.

The upper part of FIG. 19 shows a latch pulse LPf which is input from among the latch pulse supply lines 71-1 through 71-n to a data driver 16 located in a position apart from the gate driver 18. In the middle of FIG. 19, there is shown a data signal Df which is output at the latch pulse LPf shown in the upper part of FIG. 19. The lower part of FIG. 19 shows a gate signal Gf which is input to a TFT 6 in a position apart from the gate driver 18 of the gate bus lines 2. There is a gate delay in the state shown in FIG. 19, and the gate signal Gf on the gate bus line 2 is rounded. By shifting the output timing of the latch pulse LPf by a time td in accordance with the rounding of the gate signal Gf, the output timing of the output data signal Df can be also delayed by the time td. Since the delay of the output of the data signal Df causes the gate of the TFT 6 to be turned off in an output period t2 of the data signal Df (as indicated by α2 in the figure) before the switching of the data signal Dn (as indicated by β2 in the figure), the data can be accurately written in the pixel electrode 8 in spite of the fact that a gate delay has occurred.

Thus, a data signal can be output with a shift in accordance with gate rounding by dividing the latch pulse LP by the number of the data drivers 16 and by providing each of the divided latch pulses LP with a time shift in accordance with a gate delay. This makes it possible to eliminate irregularities in display provided by a liquid crystal display having a high definition and large screen, thereby allowing display with a high image quality. Obviously, a capacitor or resistor may be connected to each of the latch pulse supply lines 71-1 through 71-n to allow fine adjustment of a time delay of a signal output therefrom.

The invention is not limited to the above-described embodiments and may be modified in various ways.

For example, the above-described second embodiment is intended for elimination of irregularity of luminance attributable to a gate delay. The invention is not limited to such a purpose and may be used, for example, for preventing the occurrence of emission lines attributable to data delays that are caused by a large wiring length of repair lines used for repairing pixel defects.

Repair line for repairing defects of data bus lines are provided such that they extend through the gate driver substrate to a region which faces the data driver with the display area interposed therebetween. Therefore, repair lines have a wiring length that is considerably larger than that of data bus lines. As a result, when repair lines are used for repairing defects, a delay occurs in a data signal output to the repair lines to cause waveform rounding. Such rounding of a data signal makes a data output period at the repair lines longer than that of the data bus lines. Therefore, when there is a gate delay, since data are more sufficiently written in TFTs on the repair lines than in the data bus lines, pixels connected to the repair lines have relatively high luminance and are visually recognized as emission lines. On the contrary, the use of the embodiment of the invention makes it possible to make emission lines at repair lines less noticeable.

As described above, the present invention makes it possible to perform optimum pre-writing of at least a first line during a vertical blanking period based on a data enable signal from a system.

The present invention also makes it possible to write data signals to pixel electrodes sufficiently even if there is rounding of gate signals.

What is claimed is:

1. A liquid crystal display comprising:

a gate driver for outputting a gate signal to gate bus lines connected to gate electrodes of a plurality of thin film transistors;

a plurality of data drivers for outputting data to a plurality of data bus lines respectively connected to drain electrodes of the plurality of thin film transistors; and a timing controller having at least one latch pulse supply line which is extracted from the gate driver and is provided substantially in parallel with the gate bus lines for supplying a latch pulse for outputting data to the plurality of data drivers at output timing which is varied depending on the distance from the gate driver.

* * * * *